United States Patent [19]

Sullivan

[11] 4,317,986

[45] Mar. 2, 1982

[54] CONVERTIBLE ELECTRICALLY HEATED TOOL FOR REMOVING WOODEN OR METAL GOLF CLUB HEADS

[76] Inventor: Daniel A. Sullivan, 24 Potter St., Pawtucket, R.I. 02860

[21] Appl. No.: 47,929

[22] Filed: Jun. 12, 1979

Related U.S. Application Data

[63] Continuation-in-part of Ser. No. 949,623, Oct. 10, 1978, abandoned.

[51] Int. Cl.[3] ..... H05B 1/00; B32B 35/00; B23P 19/00

[52] U.S. Cl. ..... 219/231; 29/426.4; 81/367; 81/389; 156/344; 156/579; 156/583.1; 156/584; 219/227; 219/229; 219/230; 219/243; 432/224; 432/225

[58] Field of Search .... 29/425, 426, 427, 426.1-426.4; 432/224, 225; 34/104; 99/419; 165/185; 219/221, 227, 230, 228, 243, 535; 81/367, 387, 389; 156/583.6-583.9, 579, 584

[56] References Cited

U.S. PATENT DOCUMENTS

| | | | |
|---|---|---|---|
| 2,001,538 | 5/1935 | Mueller | 219/221 |
| 2,226,194 | 12/1940 | Berlosky | 219/230 X |
| 2,327,368 | 8/1943 | Olson | 81/389 X |
| 2,470,854 | 5/1949 | Kovac | 219/221 |
| 2,502,804 | 4/1950 | Spencer | 81/367 X |
| 2,651,251 | 9/1953 | Brown | 99/419 |
| 2,711,469 | 6/1955 | Southam | 219/243 X |
| 3,246,393 | 4/1966 | Worth | 29/426 |
| 3,412,233 | 11/1968 | Wilkie | 219/230 |
| 3,584,683 | 6/1971 | Gordon | 99/419 |
| 3,906,612 | 9/1975 | Tupy | 29/426 |

FOREIGN PATENT DOCUMENTS

| | | | |
|---|---|---|---|
| 332149 | 1/1920 | Fed. Rep. of Germany | 81/389 |
| 937099 | 12/1955 | Fed. Rep. of Germany | 219/228 |
| 480374 | 2/1938 | United Kingdom | 219/230 |

*Primary Examiner*—A. Bartis
*Attorney, Agent, or Firm*—Barlow & Barlow

[57] ABSTRACT

An electrically heated convertible tool for removing a golf club head from a shaft inserted in the hosel of both metal and wooden golf club heads includes a pair of plier-like pivotally connected opposed jaws each carrying an electric heating block. The heating blocks are disposed in opposed clamping relationship and are each provided with an arcuate recess sized to closely engage and heat the tapered hosel surface of a metal golf club head. The blocks are adjustable relative to each other to accomodate for size variations in hosels. An elongated heat exchange member having a head sized to be clamped in the arcuate recesses of the blocks and an elongated linear portion sized to be insertable into the interior of a hollow metal golf club shaft is provided to permit use of the tool to heat the hosel of a wooden club head. The tool permits heat to be applied to the hosel of the club heat to soften the cement holding the hosel to the shaft of the golf club.

4 Claims, 5 Drawing Figures

CONVERTIBLE ELECTRICALLY HEATED TOOL FOR REMOVING WOODEN OR METAL GOLF CLUB HEADS

CROSS REFERENCE TO RELATED APPLICATION

This application is a continuation-in-part of my application Ser. No. 949,623 filed Oct. 10, 1978, now abandoned.

BACKGROUND OF THE INVENTION

Heat has been applied to metal heretofore by contact of heated metal to the metal such as in soldering as shown in U.S. Pat. No. 3,412,233, but though in existence for many years, does not appear in the golf club art.

The methods heretofore used to accomplish the above in the golf club art are as follows, in the case of iron heads having metal hosels, a blow torch flame is applied to the outside of the hosel. Since products of combustion are created, blemishes appear on the hosel, which then will require metal refinishing to restore it to original condition.

In the case of wooden heads having wooden hosels and metal shafts, the wooden head with its broken off shaft intact is wrapped in two plastic boiling bags, tied around the hosel, then immersed in an electric boiling pot for about twenty minutes. Steam is created within the inner plastic bag wherein the wooden club head resides. The steam softens the epoxy bond sufficient to remove the head from the broken shaft. However, the steam generally attacks the finish, making it necessary to refinish the wooden head.

SUMMARY OF THE INVENTION

A convertible tool comprising plier-like pivoted jaws each with an actuating handle, each jaw being equipped with an electrically heated block recessed to receive a tapered golf club hosel of a metal club head for the transmission of heat thereto by contact with the surface of the recess in the block or through a heat exchange member held in the block for the wooden head. Thus, the device is adapted for use in both metal and wooden head golf clubs, the blocks being adjustable in the pivoted jaws.

DESCRIPTION OF THE PREFERRED EMBODIMENT

Figure 1:
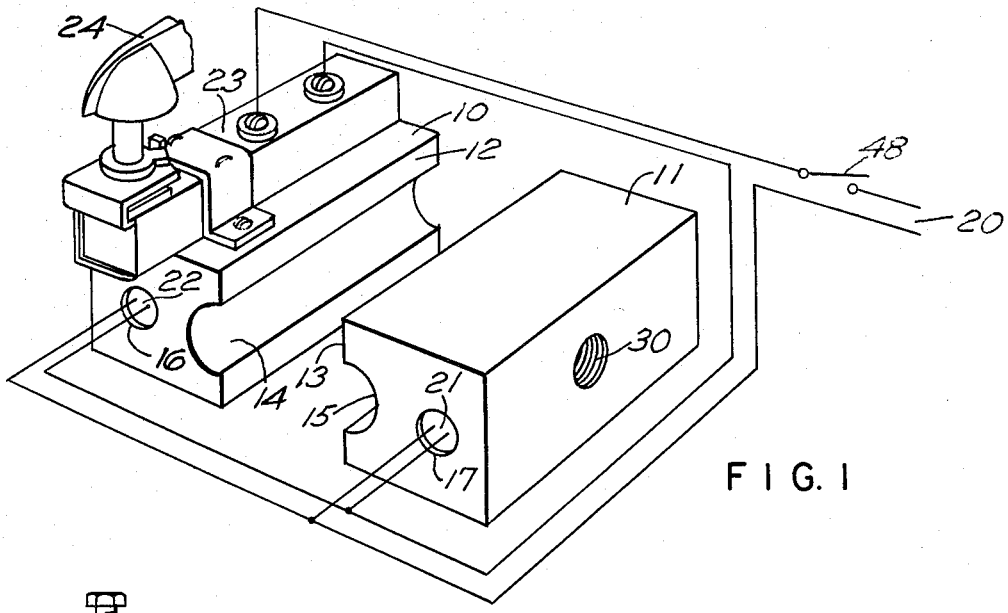
FIG. 1 is a diagrammatic view illustrating largely in perspective the heating elements which I employ for heating the hosel and shaft of a golf club for removal of the same.

Referring to FIG. 1, there is shown metal block-like members 10 and 11 which are provided with mating surfaces 12, and 13, each with concavities 14 and 15 to receive the hosel of a metal golf club head. These members 10 and 11 are each provided with a bore 16 and 17 into which a resistance electric heating element is positioned and is connected up to an electrical source 20 of some alternating current and wired as shown diagrammatically. Included in the circuit with these heating elements designated 21 and 22, respectively, there is a thermostatic control 23 which may be adjusted by handle 24 to control the current over a certain range and which may be adjusted so that the current will go on at one low temperature point and will go off at a high temperature point of the heating elements which are connected by the circuits as shown.

Figure 3:
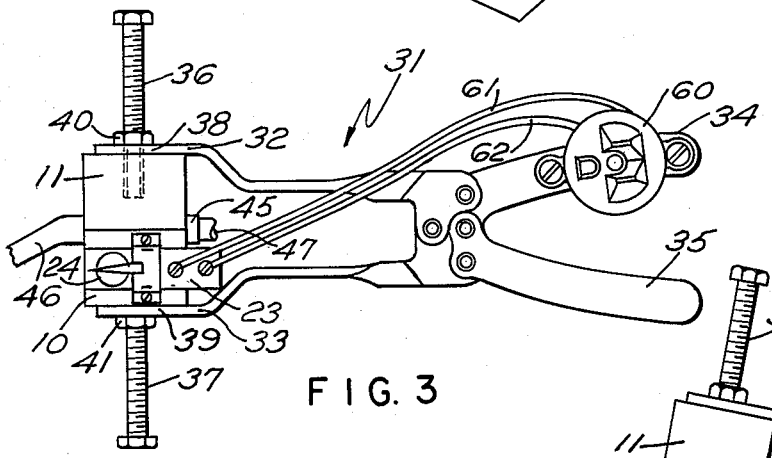
FIG. 3 is a view similar to FIG. 2 but showing the plier-like device clamping the hosel of a golf club head within the heating elements.
Figure 2:
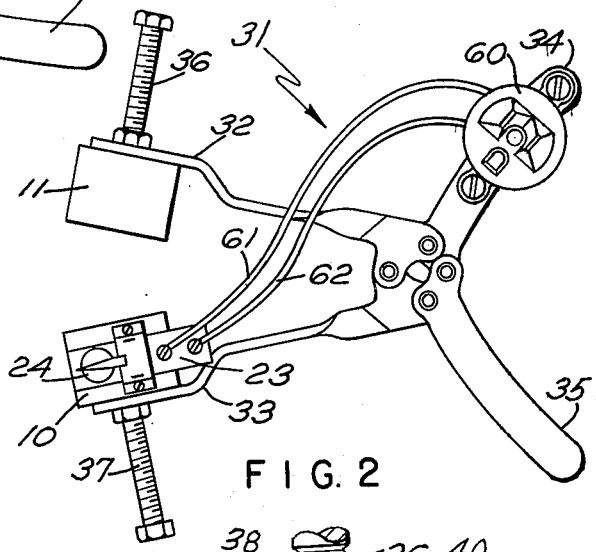
FIG. 2 is a plan view of a plier-like device into which these heating elements are secured.

Each of these heating blocks 10, 11 is provided with a threaded recess 30 so that each block may be mounted in a plier-like device designated generally 31 which consists of pivoted jaws 32, 33 with handles 34 and 35 to move the jaws toward each other with a toggle action from the position in FIG. 2 to the position in FIG. 3 where the toggle action will hold them in closed position. Each of these jaws has a threaded rod 36 and 37 which may be threaded through a threaded bore portion 38 and 39 of the jaws and into the threaded opening 30 in the blocks 10 and 11 while set nuts 40 and 41 will serve to hold these threaded rods in position. Thus, the elements 10 and 11 may be moved toward and from each other by the handles 34 and 35 so as to clamp the hosel of a metal club head which is designated 45 and seen in FIG. 3 with its head 46 in position and with the shaft 47 extending therefrom which is in position to receive the heat from the electrical source when some switch such as 48 for turning the current on and off is closed. The clamp is such that when the handles are closed, the hosel will be clamped in place without further pressure on the handles regardless of any difference in outside diameter of any hosel that may be encountered. The broken shaft to be removed from the club head is held in a shaft holder, which is a clamping device that is tightened on the shaft with a wing nut. This device is then mounted in the bench vise. The method of heating is then applied, permitting club head removal. After the heat is applied while the device is clamped in place by closure of the handles 34 and 35, softening of the epoxy cement will occur after two to three minutes. The shaft may then be rotated or twisted relative to the hosel, and when this occurs, the shaft may be withdrawn from the hosel, all without injury to the finish of the hosel or golf club head.

Figure 4:
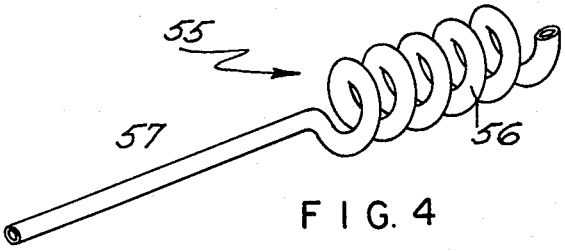
FIG. 4 is a perspective view of an additional part utilized in the heating of the inside of a hollow golf club shaft.
Figure 5:
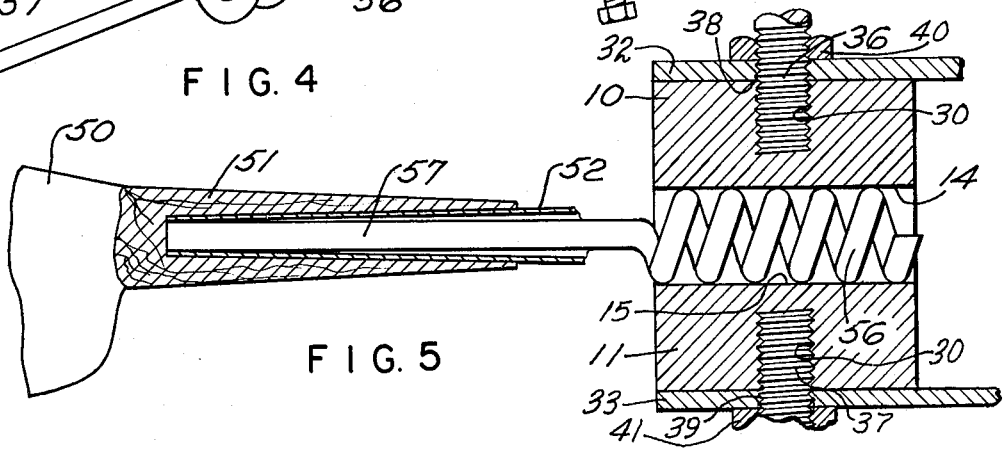
FIG. 5 is a plan view with parts in section illustrating the use of the part shown in FIG. 4 in the heating elements and with one part extending into the hollow golf club shaft which is within the hosel of a wooden club head.

In cases where a wooden club head such as designated 50 in FIG. 5 with its wooden hosel 51 is to be removed from the broken-off hollow metal shaft 52, a device such as shown at 55 in FIG. 4 will be utilized by placing the head or coiled portion 56 thereof in the concave jaws 14 and 15 with its straight portion 57 extending into hollow shaft 52, while in the hosel 51 of the club head, and then heat will be applied by contacting the metal portion 57 of the device 55 against the inner surface of the hollow club shaft 52 until it is heated, and this heat has melted the epoxy cement of the bond between the metal part of the shaft 52 and the wooden part of the head 51. Similarly, a torsion action may occur between the club head and the shaft until some slight twisting rotation may be had and the club head may be removed from the shaft.

There is in existence a holder for a shaft which may be clamped on the shaft and then this may be placed in a bench vise for better holding the parts to have the heat applied.

However, if the shaft is broken off at the entrance to the hosel, such condition does not permit use of the shaft holder. Heat is applied internally to the broken shaft tip by use of the pigtail, which is removed when sufficient heat has been applied. Then a tempered hook tool is inserted to engage the shaft tip at its bottom end and the shaft tip is withdrawn in this manner.

This device may also be used to remove the sole plate from a wooden club by placing the blocks 10, 11 against the plate. For convenience an electrical receptacle 60 may be mounted on handle 34 to receive the double prong of an extension cord from an electrical 110 volt outlet and from the base of this receptacle wires 61, 62 may lead to the heating thermostat 23 and from there to the heating elements 10, 11 as shown in FIG. 1.

I claim:

1. An electrically heated convertible tool for removing a golf club head hosel from a shaft in the hosel of both metal and wooden golf club heads, said tool comprising plier-like pivotally connected opposed jaws, each with a threaded opening therethrough and each with an actuating handle, a pair of heating blocks, each block having a threaded recess and being secured to a different one of said jaws by a threaded member threaded through the threaded opening of the jaw into the threaded recess of the block, a lock nut on each threaded member cooperating with the jaw to lock the threaded member relative to the jaw, said blocks being adapted to be disposed in opposed clamping relationship around the hosel of a metal club head and each being providing with an arcuate recess facing the recess of the other block, said recesses being sized to engage the tapered hosel surface of the metal golf club head, an electrical heating element in each block for heating the block and thereby the hosel received in the arcuate recess, said blocks being selectively adjustable toward and away from each other by said threaded members to accomodate for size variations in hosels, an elongated heat exchange member having a head sized to be clamped in said arcuate recesses of said blocks in contact with the walls of the recesses, said member having an elongated linear portion extending from said head and being of a size to extend into the interior of a hollow metal golf club shaft secured in the hosel of a wooden club head, whereby the elongated heat exchange member may be ommitted for use with a metal head club and is used for insertion in broken-off metal shaft of the hosel of a wooden head club.

2. A device as in claim 1 wherein the portion of the member held in said arcuate recesses is a helical coil.

3. A device as in claim 1 wherein said device has handles and an electrical receptacle is mounted on one of said handles.

4. A device as in claim 1 wherein a thermostat is provided mounted on one of the blocks in heat transfer relation to control the electrical current applied.

* * * * *